US005902220A

United States Patent [19]

Lin

[11] Patent Number: 5,902,220

[45] Date of Patent: May 11, 1999

[54] RECLINING CHAIR WITH EXERCISING FUNCTION

[76] Inventor: Chen-Da Lin, P.O. Box 82-144, Taipei, Taiwan

[21] Appl. No.: 09/049,903

[22] Filed: Mar. 30, 1998

[51] Int. Cl.[6] ..... A63B 23/02; A47C 01/02

[52] U.S. Cl. ..... 482/142; 297/316; 482/907; 482/92

[58] Field of Search ..... 482/92, 142, 121, 482/122, 129, 130, 140, 145, 907, 96; 297/316, 342, 50; 5/154

[56] References Cited

U.S. PATENT DOCUMENTS

| | | | |
|---|---|---|---|
| 1,263,911 | 4/1918 | Lowy | 297/316 X |
| 2,724,428 | 11/1955 | Sellner | 482/142 X |
| 2,938,572 | 1/1960 | Solloway | 482/142 |
| 3,043,591 | 7/1962 | Sellner | 482/142 |
| 3,075,518 | 1/1963 | Sellner | 482/142 |
| 3,378,259 | 4/1968 | Kupchinski | 482/142 |
| 3,491,998 | 1/1970 | Lyon | 297/316 X |
| 3,589,715 | 6/1971 | Mark | 482/142 |
| 3,596,906 | 8/1971 | Parmer | 482/142 |
| 3,716,630 | 2/1973 | Mark | 482/142 |
| 3,767,190 | 10/1973 | Biggerstaff | 482/142 |
| 3,773,383 | 11/1973 | Ekorness | 297/316 X |
| 3,782,717 | 1/1974 | Berlin | 482/142 |
| 3,947,069 | 3/1976 | Lusch | 297/316 |
| 5,665,042 | 9/1997 | Breaux | 482/142 |
| 5,681,250 | 10/1997 | Hoover | 482/142 |
| 5,769,767 | 6/1998 | Hochberg | 482/142 |

*Primary Examiner*—Stephen R. Crow
*Assistant Examiner*—William LaMarca
*Attorney, Agent, or Firm*—A & J

[57] ABSTRACT

A reclining chair with exercising function includes symmetrical front and rear chair frames, and an adjusting rod pivotally connected to said front and rear chair frames by connecting plates. The adjusting rod is connected by springs to the rear chair frame. Both sides of the front chair frame are respectively provided with connecting plates to pivotally connect to a securing rod and a front support rod. The rear chair frame is pivotally connected to a rear support rod at both sides thereof by connecting plates. When the adjusting rod is retained at a bottom rod, an ordinary reclining chair is accomplished. When the adjusting rod is pulled upwardly, the reclining chair will bent downwardly or upwardly for V-shaped or inverted V-shaped body exercises.

3 Claims, 4 Drawing Sheets

RECLINING CHAIR WITH EXERCISING FUNCTION

BACKGROUND OF THE INVENTION

1. Field of the Invention

The present invention relates generally to a reclining chair with exercising function, and more particularly to a reclining chair utilizable as a waist bending exerciser.

2. Description of the Prior Art

Modern people work under stress and pressure and often suffer from sore back and waist. Cities are densely populated, and one's living space is limited. Exercising apparatuses are often expensive and occupy much space.

SUMMARY OF THE INVENTION

The present invention relates generally to a reclining chair with exercising function, and more particularly to a reclining chair utilizable as a waist bending exerciser.

A primary object of the present invention is to provide a reclining chair which may be used as a body exerciser. To achieve this object, the reclining chair of the present invention comprises symmetrical front and rear chair frames pivotally connected to an adjusting rod by connecting plates. The adjusting rod is connected by springs to the rear chair frame. Both sides of the front chair frame are respectively provided with connecting plates to pivotally connect to a securing rod and a front support rod. The rear chair frame is pivotally connected to a rear support rod by connecting plates at both sides thereof. When the adjusting rod is engaged at a bottom rod, an ordinary chair is accomplished. When the adjusting rod is pulled upwardly, the reclining chair will bent downwardly or upwardly to allow V-shaped or inverted V-shaped body exercises.

Another object of the present invention is to provide a collapsible reclining chair by means of an adjusting rod and by bending front and rear support rods to facilitate carrying and storage.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
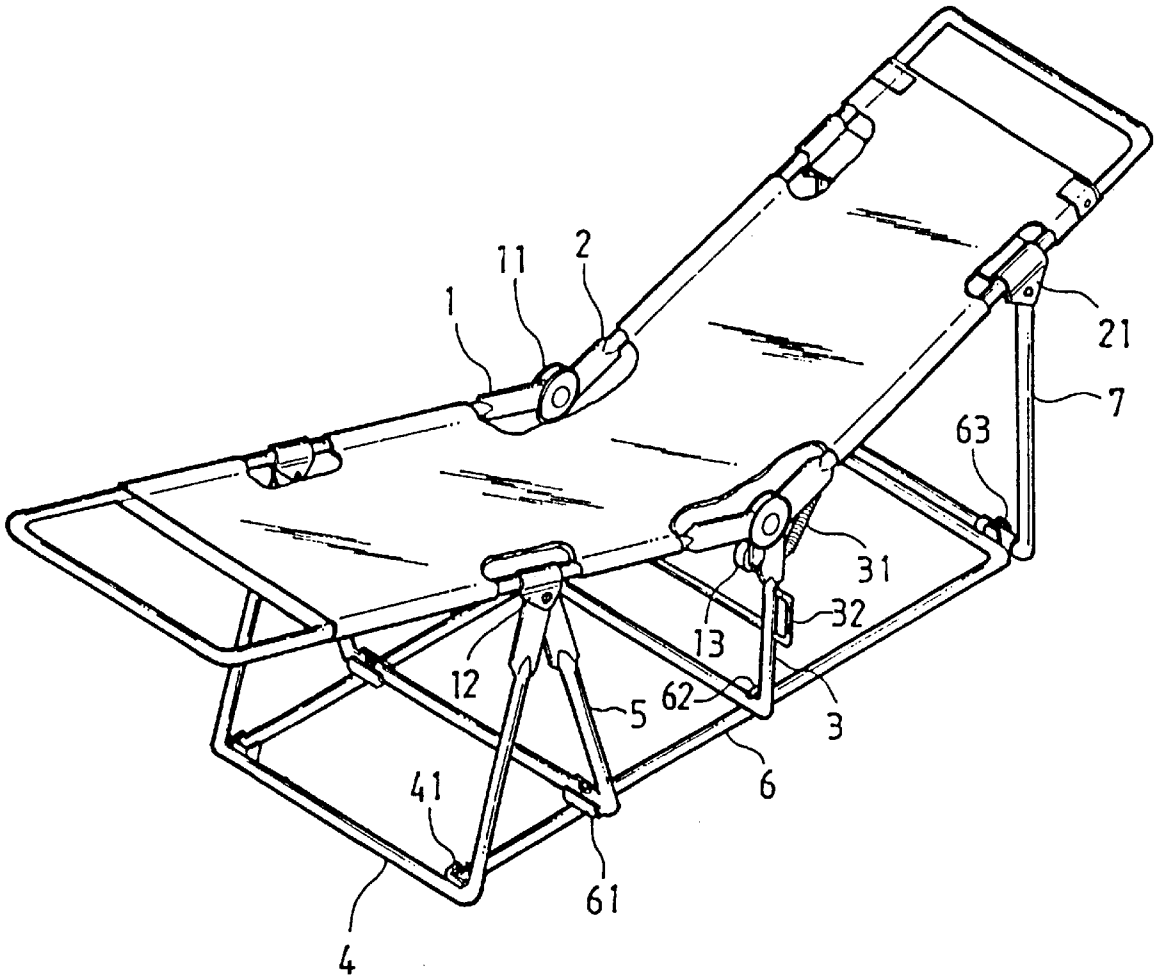
FIGS. 1, 2 and 3 are schematic perspective views of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
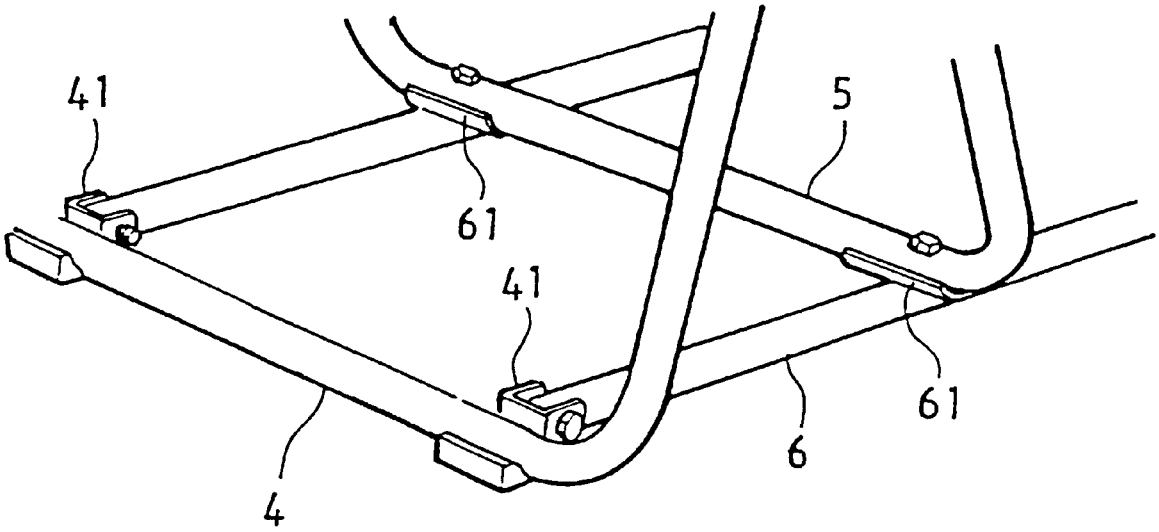
Figure 3:
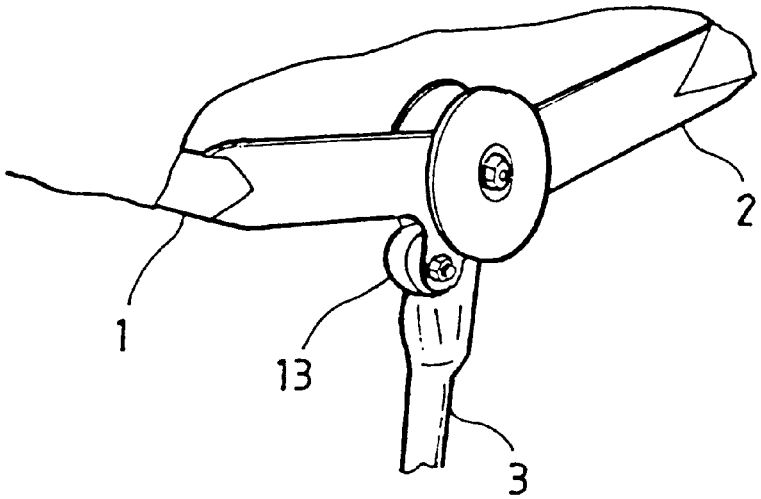
Figure 4:
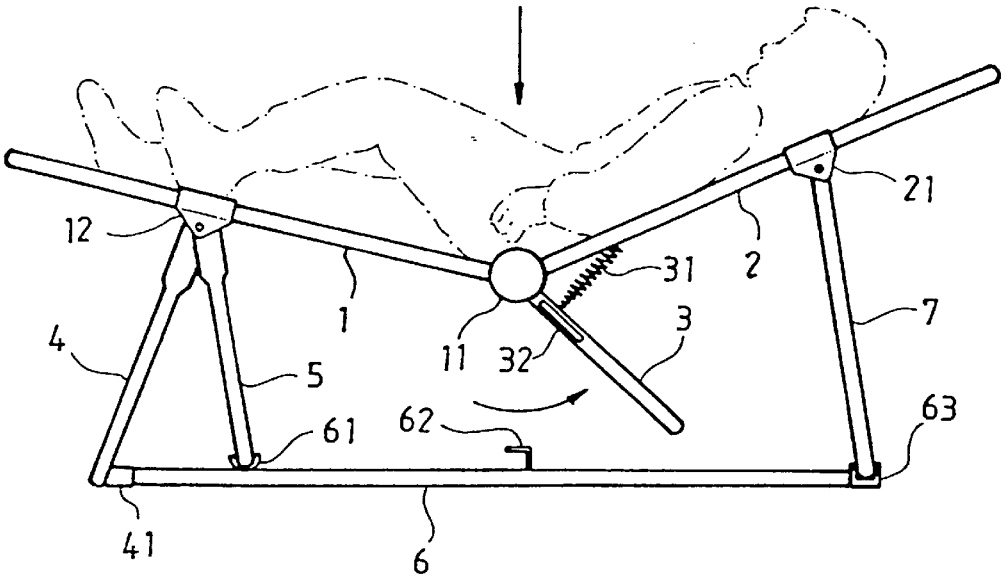
FIG. 4 is a schematic view illustrating the present invention in a downwardly bent state during use.

With reference to FIGS. 1, 2, and 3, the present invention essentially comprises front and rear chair frames 1 and 2, which are connected by circular connecting plates 11 and pivotally connected to an adjusting rod 3. The adjusting rod 3 is connected via spring 31 to two longitudinal side rods of the rear chair frame 2. The two sides of the front chair frame 1 is provided with a triangular connecting plate 12 to pivotally connect to a securing rod 4 and a front support rod 5. The bottom end of the securing rod is connected to two symmetrical inverted U-shaped mount 41. The inverted U-shaped mounts 41 are connected to a bottom rod 6 that may be placed flat on the floor and bendable along the inverted U-shaped mounts 41. The bottom rod 6 is provided with curved supports 61 and bent retaining hooks 62 respectively at suitable positions to support and engage the front support rod 5 and the adjusting rod 3.

Both sides of the rear chair frame 2 are respectively provided with triangular connecting plate 21 to pivotally connect a rear support frame 7. The support frame 7 may be insertably placed in retaining grooved seats 63 at the rear end of the bottom end 6 to form a reclining chair. When the adjusting rod 3 is pulled upwardly by its retaining hooks 62 via a handle 32 thereof, a chair surface will bend downwardly or upwardly with the connecting plates 11 as pivots. Furthermore, the joints between the front chair frame 1 and the connecting plates 11 are provided with a stop packing ring 13 to make the reclining chair, upon bending, urge against the front support rod 5 to avoid collision of the rods.

Figure 5:
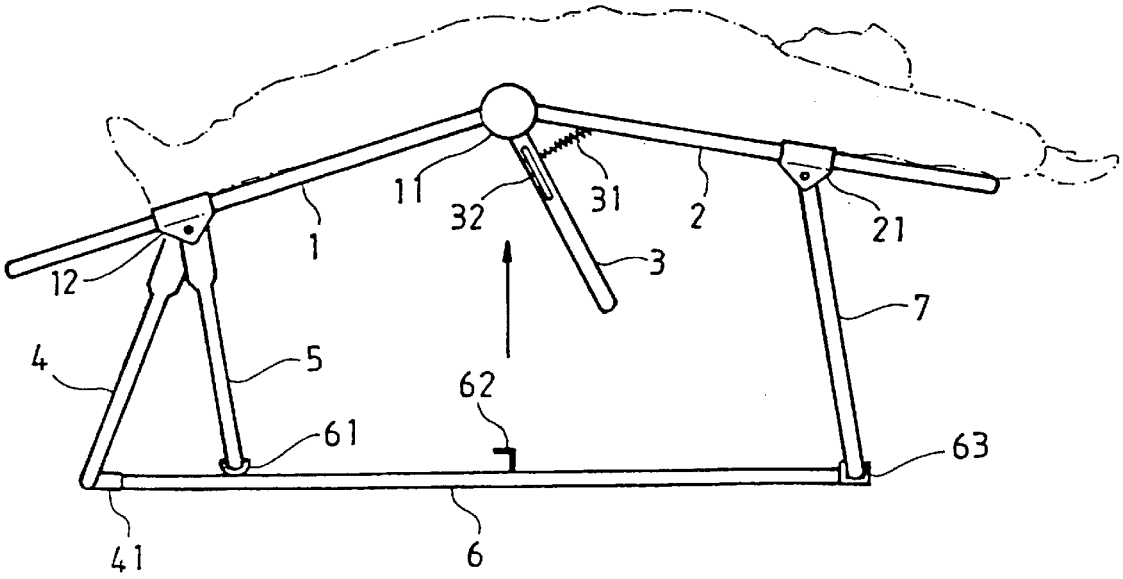
FIG. 5 is a schematic view illustrating the present invention in an upwardly bent state during use.

Referring to FIG. 5, when using the reclining chair of the present invention in exercising, the handle 32 may be manipulated to control the adjusting rod 3 so that it disengages from the retaining hooks 62. Due to the pulling force of the springs 31, the adjusting rod 3 becomes suspended. In this way, the user may use the connecting plates 11 as pivots and press the chair surface downwardly with his/her body to perform V-shaped bending body exercises.

Referring to FIG. 3, when the adjusting rod 3 is pulled upwardly, the user may press the two ends of the reclining chair with his/her head and feet so that the ends of the chair surface displace downwardly, thereby causing the connecting plates 11 serving as pivots to bend upwardly, allowing inverted V-shaped body exercises.

Figure 6:
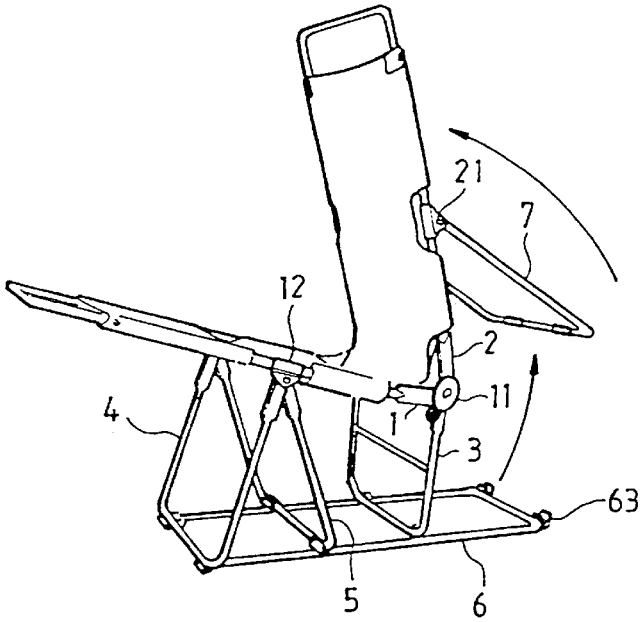
FIGS. 6, 7 and 8 are schematic views illustrating folding of the present invention.
Figure 7:
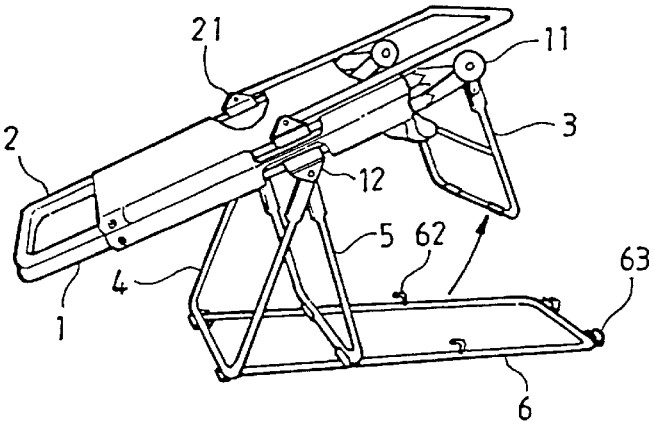
Figure 8:
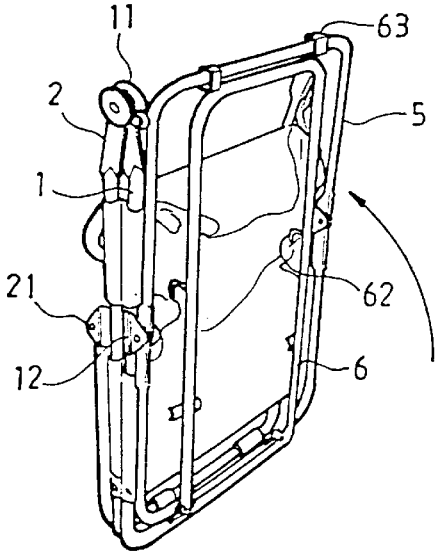

Referring to FIGS. 6, 7, and 8, to fold up the reclining chair of the present invention, the support rod 7 is firstly disengaged from the retaining grooved seats 63 and the rear chair frame 2 is bent forwardly (as shown in FIG. 6). Then the adjusting rod 3 and the front support rod 5 are respectively disengaged from the retaining hooks 62 and the curved support plates 61, and are bent forwardly respectively (as shown in FIG. 7). Finally, the bottom rod 6 is bent upwardly so that it lies close against the collapsed front and rear chair frames 1 and 2. The entire reclining chair may thus be folded up in a compact size to facilitate carrying and storage.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential a characteristics of the generic or specific aspects of this invention.

I claim:

1. A reclining chair with exercising function, comprising front and rear chair frames pivotally connected by circular connecting plates to an adjusting rod, said adjusting rod being connected by springs to two longitudinal side rods of said rear chair frame, both sides of said front chair frame being provided with a triangular connecting plate to pivotally connect to a securing rod and a front support rod, wherein a bottom end of said securing rod is connected to two symmetrical inverted U-shaped mounts which are pivotally connected to a bottom rod bendable along said inverted U-shaped mounts, said bottom rod being provided with curved support plates, bent retaining hooks and retaining grooved seats at suitable positions and a rear end thereof, said front and rear support rod being respectively fitted in said curved support plates and retaining grooves seats, and said adjusting rod being retained by said retaining hooks to form a reclining chair which, when said adjusting rod is pulled upwardly, may bend downwardly or upwardly to allow V-shaped or inverted V-shaped body exercises.

2. The reclining chair with exercising function as claimed in claim 1, wherein said adjusting rod is provided with a handle to facilitate manipulation of said adjusting rod.

3. The reclining chair with exercising function as claimed in claim 1, wherein joints between said front chair frame and said circular connecting plates are provided with stop packing rings to avoid collision of the rods when said reclining chair is bent.

* * * * *